US005078385A

United States Patent [19]

Serita

[11] Patent Number: 5,078,385

[45] Date of Patent: Jan. 7, 1992

[54] SORTING APPARATUS HAVING VARIABLE LENGTH GUIDE PLATES

[75] Inventor: Nobuhito Serita, Kanagawa, Japan

[73] Assignee: Kabushiki Kaisha Toshiba, Kawasaki, Japan

[21] Appl. No.: 400,796

[22] Filed: Aug. 30, 1989

[30] Foreign Application Priority Data

Nov. 29, 1988 [JP] Japan ..... 63-299741

[51] Int. Cl.[5] ..... B65H 39/10

[52] U.S. Cl. ..... 271/296; 271/300; 355/323

[58] Field of Search ..... 355/323, 322, 321; 271/287, 292, 296, 293, 300, 302

[56] References Cited

U.S. PATENT DOCUMENTS

| | | | |
|---|---|---|---|
| 3,879,032 | 4/1975 | SHirahase | 271/293 |
| 4,322,069 | 3/1982 | Mitchell | 355/323 X |
| 4,534,643 | 8/1985 | Watanabe | 355/323 X |
| 4,618,245 | 10/1986 | Fukushi et al. | 355/323 X |
| 4,624,546 | 11/1986 | Fukushi et al. | 271/296 X |
| 4,709,915 | 12/1987 | Ishikawa et al. | 271/296 X |
| 4,822,025 | 4/1989 | Chung | 271/296 |

FOREIGN PATENT DOCUMENTS

| | | | |
|---|---|---|---|
| 0163251 | 10/1982 | Japan | 355/323 |
| 0036860 | 3/1983 | Japan | 271/287 |
| 0100368 | 5/1987 | Japan | 271/293 |
| 0175384 | 8/1987 | Japan | 271/287 |

*Primary Examiner*—A. T. Grimley
*Assistant Examiner*—Robert Beatty
*Attorney, Agent, or Firm*—Foley & Lardner

[57] ABSTRACT

A copying machine includes a copying unit, an automatic original feeding unit, and a sorting unit. The sorting unit includes discharging rollers and a tray unit. The tray unit is detachable to a main body and includes a plurality of trays which are detachably connected to the tray unit. The discharging rollers are located in the main body and moves upward and downward. The sorting unit further includes a tray detecting device which detects the position of a tray of the tray unit. Before the copying unit makes a copy, the detecting device detects the tray unit and each tray of the tray unit. When one of the trays is detected, a CPU memorizes the position of the tray and controls the discharging rollers to move upward or downward to the position facing the tray of the tray unit. A sheet from the copying unit is conveyed to the sorting unit. The sorting unit includes a pair of guide plates which define a guide path. The length of the guide path will vary according to the position of the tray in which the sheet is to be discharged.

2 Claims, 11 Drawing Sheets

SORTING APPARATUS HAVING VARIABLE LENGTH GUIDE PLATES

BACKGROUND OF THE INVENTION

1. Field of the Invention

This invention relates to an image formation apparatus, such as an electronic copying machine, provided with a selective sheet sorting function.

2. Description of the Prior Art

Known electronic copying machines of a known construction include a copying device, an automatic original feeder and a sorting device.

The sorter device includes a vertically movable support frame, a plurality of trays stacked vertically along the support frame, and a pair of feed rollers which transport sheet material discharged by the copying device via a pair of discharge rollers to a selected one of trays. A sorter device of this type is disclosed in U.S. Pat. Nos. 3,879,032 and 4,618,245.

In the sorter device of the above known arrangement, the sorting capacity depends on the number of trays and the space between adjacent trays. The number of trays decides the number of copies that can be sorted. For example, if the sorting device has twenty trays, operators must use the copying device for sorting no more than twenty copies. The space between adjacent trays decides the number of original documents to the copied in the sorting mode. This is because, in the sorting mode, copied papers are discharged onto each tray of the stacked trays. For example, if the space between adjacent trays corresponds to twenty papers, twenty-one to forty original documents must be copied in two separate copying operations.

Prior art sorting devices thus fail to satisfy the various demands for sorting.

SUMMARY OF THE INVENTION

An object of the invention is to provide a sorting apparatus capable of changing its sorting ability.

In accordance with the present invention, the foregoing objects, among others, are achieved by providing a sorting apparatus for distributing a plurality of sheet materials onto at least one tray, comprising a frame; connecting means for detachably connecting at least one tray to the frame; detecting means for detecting a position at which the tray is connected to the frame; and distributing means for discharging the sheet material onto the tray in accordance with the position detected by the detecting means.

Other objects, features, and advantages of the present invention will become apparent from the following detailed description. It should be understood, however, that the detailed description and specific examples while indicating preferred embodiments of the invention, are given by way of illustration only, since various changes and modification within the spirit and scope of the invention will become apparent to those skilled in the art from this detailed description.

Figure 1:
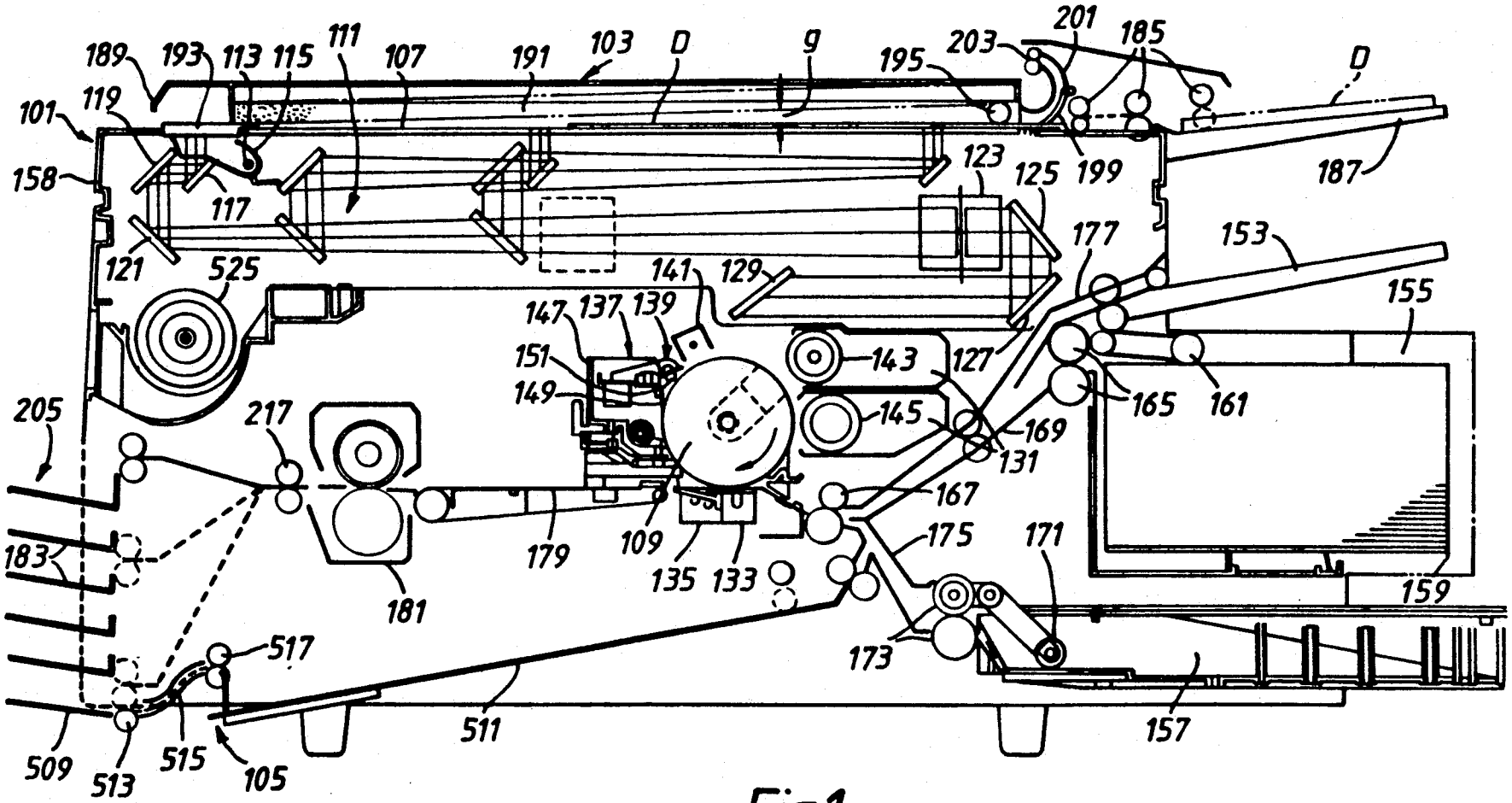
FIG. 1 is a cross section of an electronic copying machine representative of the image formation apparatus according to the present invention.
Figure 8:
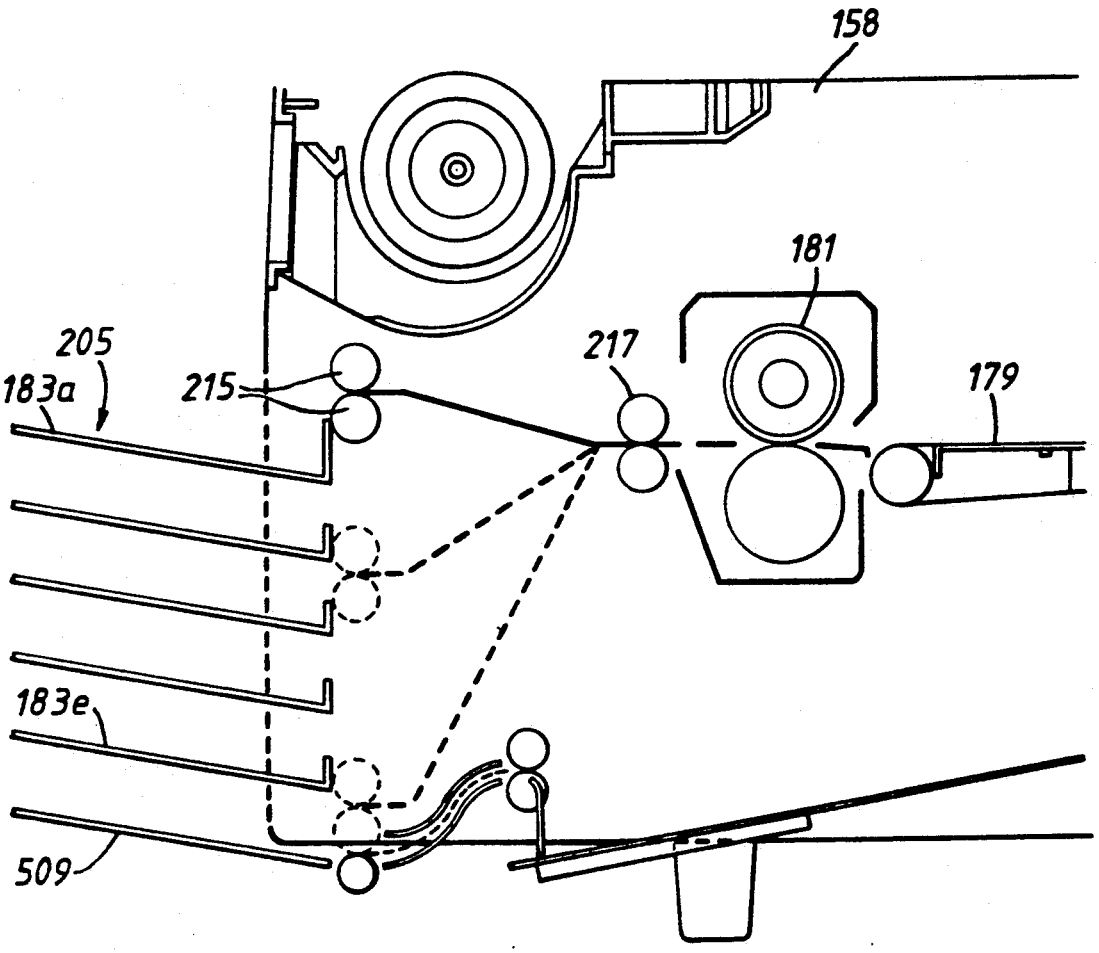
Figure 9:
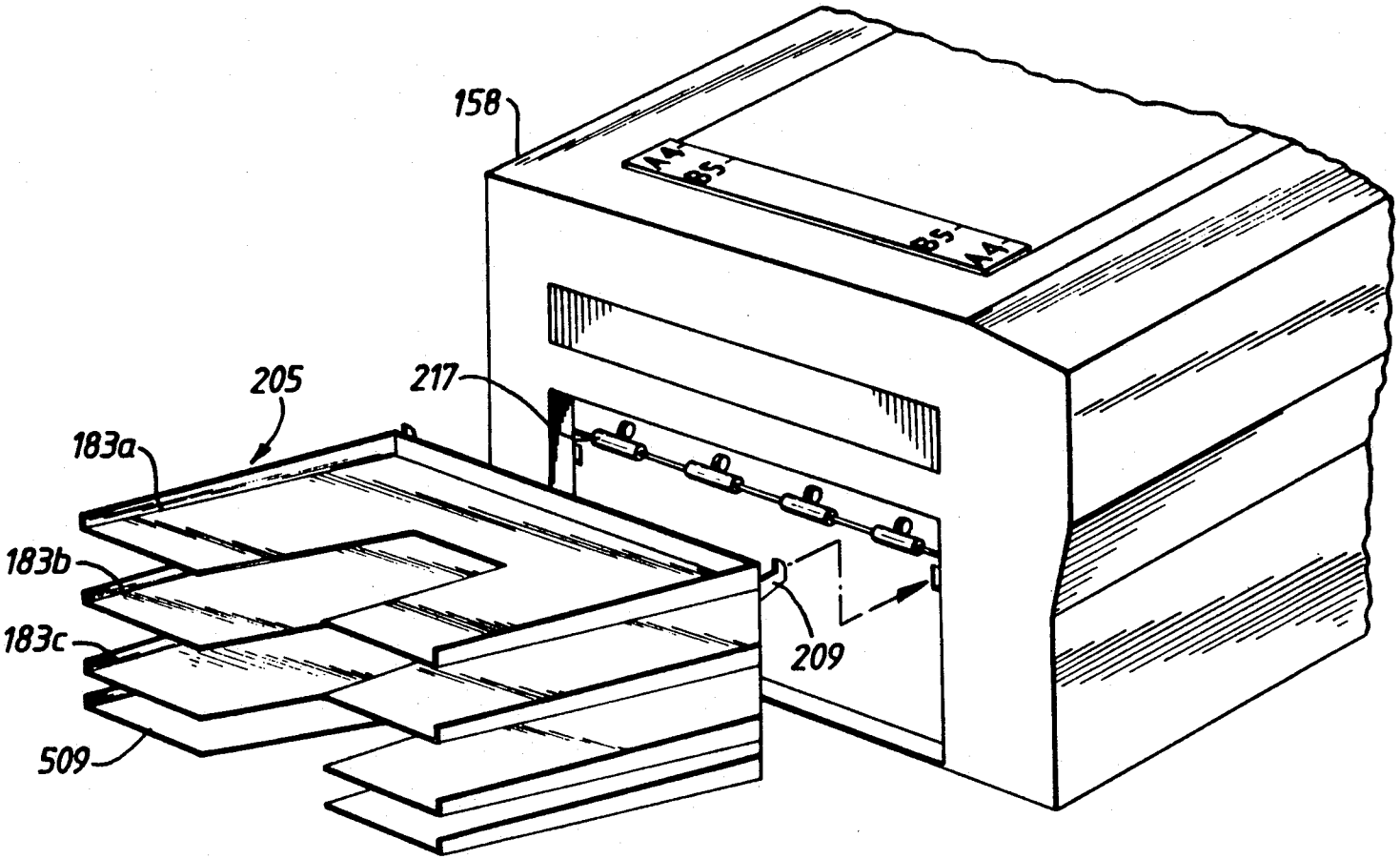
Figure 10:
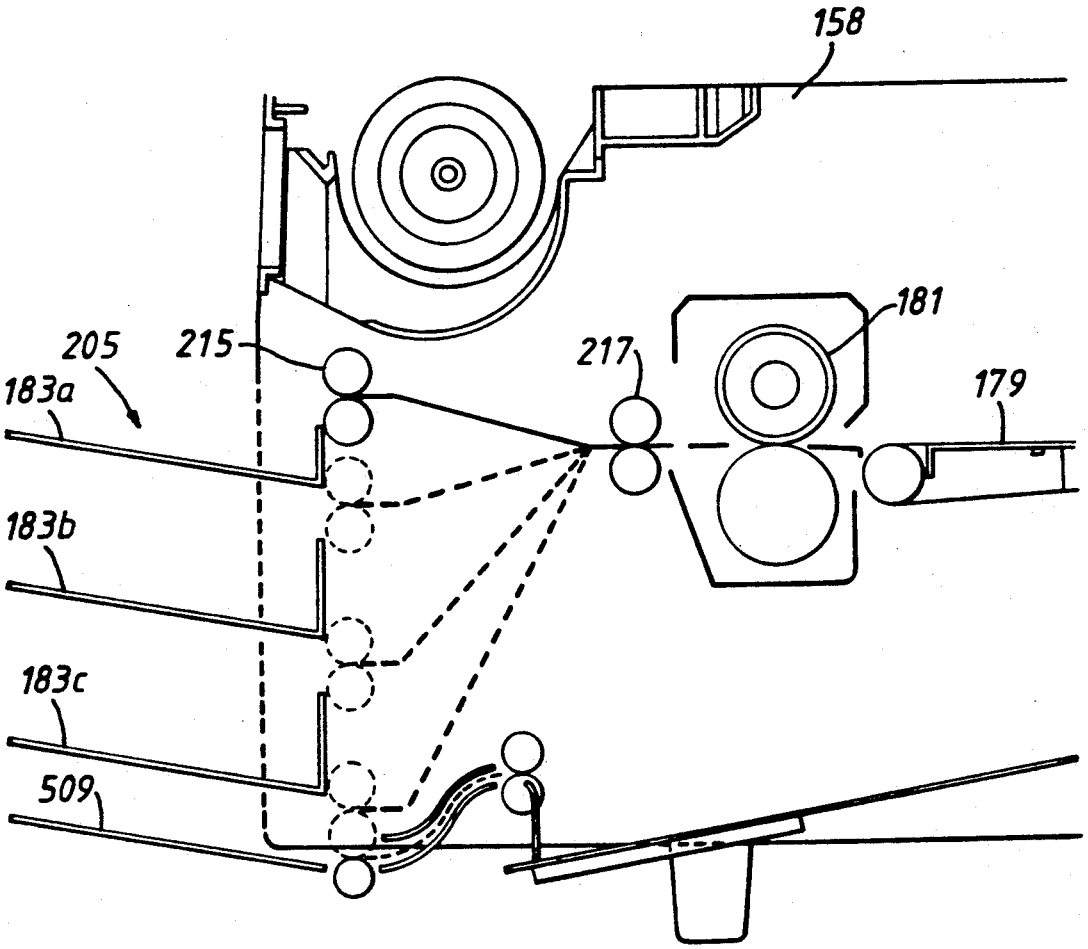

FIGS. *7a* and *7b* constitute a flow chart illustrating the operation of the copying machine shown in FIG. 1;

FIG. 8 is a sectional view of the sorting unit illustrating the sorting mechanism;

FIG. 9 is a perspective view of the insertion of the tray with three trays and a reversing tray;

FIG. 10 is a sectional view of the sorting unit shown in FIG. 9; and

Figure 11:
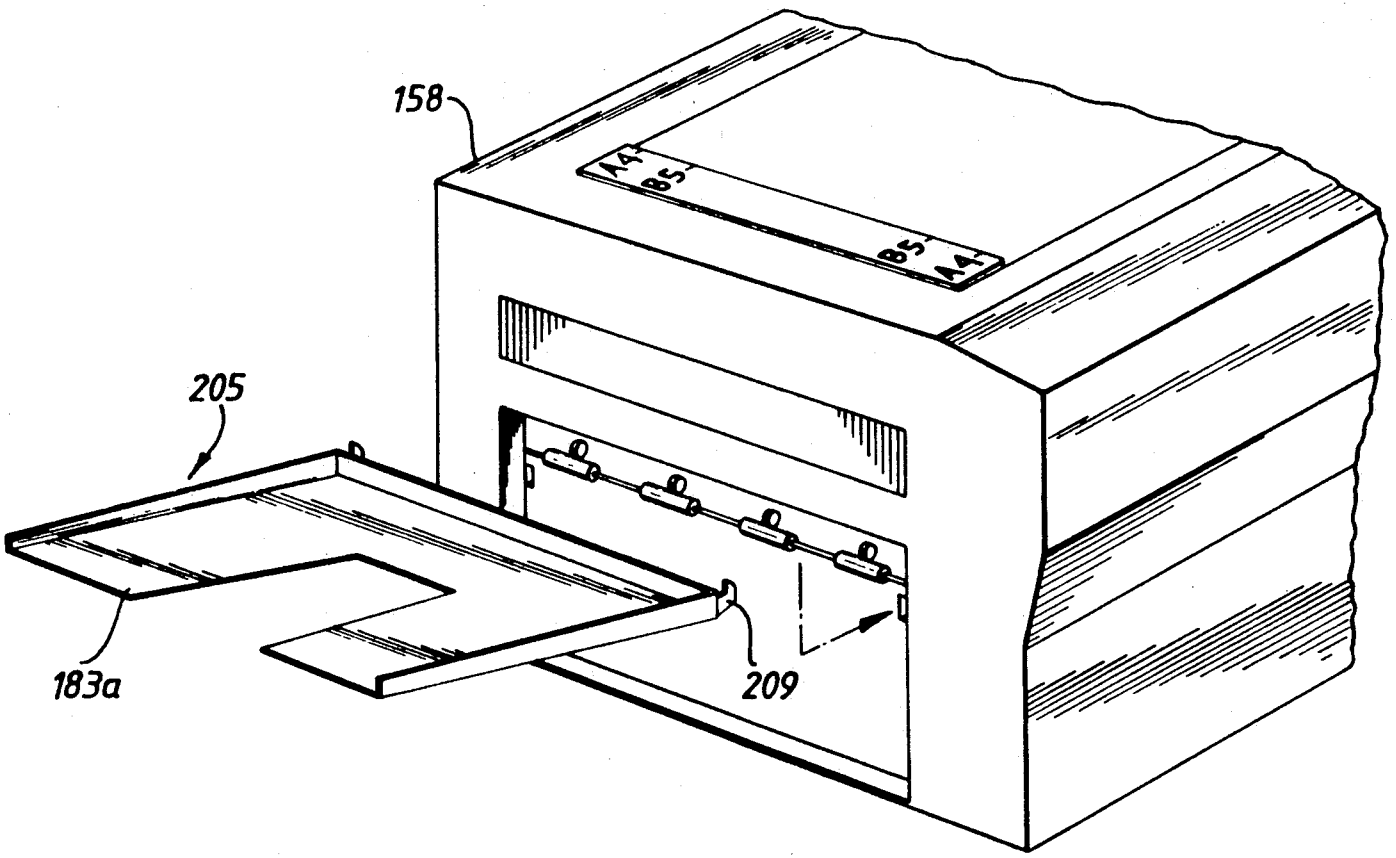

FIG. 11 is a perspective view of the insertion of the tray unit with one tray.

DETAILED DESCRIPTION OF THE PREFERRED EMBODIMENTS

Referring now to FIG. 1, an electronic copying machine includes a copying unit 101, an automatic original feeding unit 103 (hereafter referred to as ADF) and a sorting unit 105.

Secured on copying unit 101 is an original document table 107 of a transparent glass for placement of an original D to be copied. A photosensitive drum 109 is rotated, within copying unit 101, substantially at a center thereof.

Between original document table 107 and photosensitive drum 109 is interposed an exposure device 111 which includes a lamp 113. Lamp 113 is surrounded at its rear portion by a reflector 115. A light emitted by lamp 113 is projected by reflector 115 to the surface of the original D placed on original document table 107. Original D placed on original document table 107 is scanned in incremental lines while being irradiated by lamp 113. The light reflected by original D is focused on the surface of photosensitive drum 109 to form a latent image thereon, past first to third mirrors 117, 119 and 121, a lens 123, fourth to sixth mirrors 125, 127 and 129 in the order mentioned. Lamp 113 and first mirror 117 are mounted on a first carriage (not shown in FIG. 1), and second and third mirrors 119 and 121 on a second carriage (not shown FIG. 1). During scanning of the original D, the first and second carriages move along table 107 reciprocally in synchronism with the rotation of photosensitive drum 109. In order to make constant the length of an optical path between original D and photosensitive drum 109, the second carriage reciprocates in the same direction as the first carriage at a speed one half that of the first carriage.

The latent image is made visible by a developer device 131. The developed image is transferred onto sheet material, such as a paper by a transfer device 133. The sheet with the developed image is separated from photosensitive drum 109 by a separation device 135. After the sheet is separated, a residual toner on the surface of photosensitive drum 109 is removed by a cleaner device 137. A discharging device 139 discharges the residual charge on the cleaned surface of photosensitive drum 109. The discharged photosensitive drum 109 is uniformly charged by a charging device 141. Adjacent to the position of the image focused by exposure device 111 in the direction of photosensitive drum rotation and about photosensitive drum 109 are developer device 131, transfer device 133, separation device 135, cleaner device 137, discharging device 139 and charging device 141 in the order mentioned.

Corona charging devices are used respectively as transfer device 133, charging device 141 and separation device 135.

Developer device 131 includes an upper developer unit 143 with a first toner and a lower developer unit 145 with a second toner which is black. The first toner is a different kind of toner from the second toner, e.g., color toner. Upper and lower developing unit 143 and 145 include developing rollers under a magnetic brush developing process. The developing rollers selectively approach photosensitive drum 109 whereby black toner or toner in another color, such as red, may be selectively supplied on the surface of photosensitive drum 109.

Cleaner device 137 comprises a casing 147, a cleaning blade 149 for scraping off the residual toner from the surface of photosensitive drum 109. Toner removed by cleaning blade 149 is transported by an auger (not shown) to a collecting box (not shown).

Discharging device 139 comprises a discharging lamp 151 for irradiating the entire surface of photosensitive drum 109 to be at a uniform surface potential.

Disposed within copying device 101 at a bottom right-hand portion are, in the order from top to bottom, a manual guide 153, a large capacity feeder (hereafter referred to as LCF) 155 and a cassette 157. LCF 155 stores a plurality of sheets e.g., a thousand sheets. Cassette 157 is detachably connected to a copying body 158.

LCF 155 includes a sheet feeding plate on which a large supply of sheets can be stored. The top sheet of the accumulated supply of sheets is picked up by a first pick-up roller 161. The position of the top sheet is detected by a dector (not shown). In response to the detector, an elevating device (not shown) constantly sets the top sheet in a position ready for delivery by pick-up roller 161. The picked-up paper is separated individually by first separating rollers 165 in the case that pick-up roller 161 takes out the sheets twofold. The separated paper is guided to an aligning roller 167 by a first guide 169.

The top sheet of cassette 157 is picked up by a second pick-up roller 171. The picked-up paper is separated by second separating rollers 173. The separated paper is guided to aligning rollers 167 by a second guide 175. Third guide 177 leads the sheet on manual guide 153 towards aligning roller 167.

The sheet from manual guide 153, LCF 155 or cassette 157 is aligned by aligning roller 167. Synchronously with the rotation of photosensitive drum 109, aligning roller 167 feeds the sheet to a transferring section between photosensitive drum 109 and transfer device 133.

As described above, the toner image is transferred onto the sheet through transfer device 133 and separation device 135. A convey belt 179 conveys the separated sheet to a fixing unit 181 which fixes the toner image on the sheet by heat and pressure.

The fixed sheet is discharged onto one of trays 183 of sorting unit 105 which is illustrated in detail hereafter.

ADF 103 includes a plurality of rollers 185 to feed original D set on an original feeding plate 187 to original document table 107. Original document table is covered with a platen cover 189 which is hollow. In platen cover 189 is disposed an inner plate 191 which is movable up and down in platen cover 189. The right side edge of inner plate 191, which is nearer to original feeding plate 187, can be located in higher or lower position by a driver (not shown in FIG. 1). When the original D is picked up from original feeding plate 187, the right-side edge is located in the higher position so that between original document table 107 and inner plate 191 there is a gap g to permit original D to be fed onto original document table 107. After original D is stopped by a stopper 193, inner plate 191 is located in the lower position so that inner plate 191 pushes original D against original document table 107.

When original D is fixed on original document table 107, exposure device 111 begins to scan original D. After exposure device 111 finishes scanning, inner plate 191 is located in the higher position. A feeding roller 195 feeds original D on original document table 107 out of platen cover 189.

Feeding roller 195 is deposited in platen cover 189 and near the right-side edge of platen cover 189 and is movable against and off original document table 107. Inner plate 191 has a cut (not shown in FIG. 1) to avoid interfering with feeding roller 195.

The fed original D is discharged onto a discharging plate, which is located at an upper portion of platen cover 189, through a movable lever 199, a guide 201 and a discharging roller 203. Movable lever 199 is curved so that document D coming to platen cover 189 pushes up movable lever 199 and document D coming out of platen cover 189 goes along movable lever 199. After discharging document D, another following document D on original feeding plate 187 is conveyed onto original document table 107 in the same manner as the previous document D until all of the documents D is copied.

Figure 2:
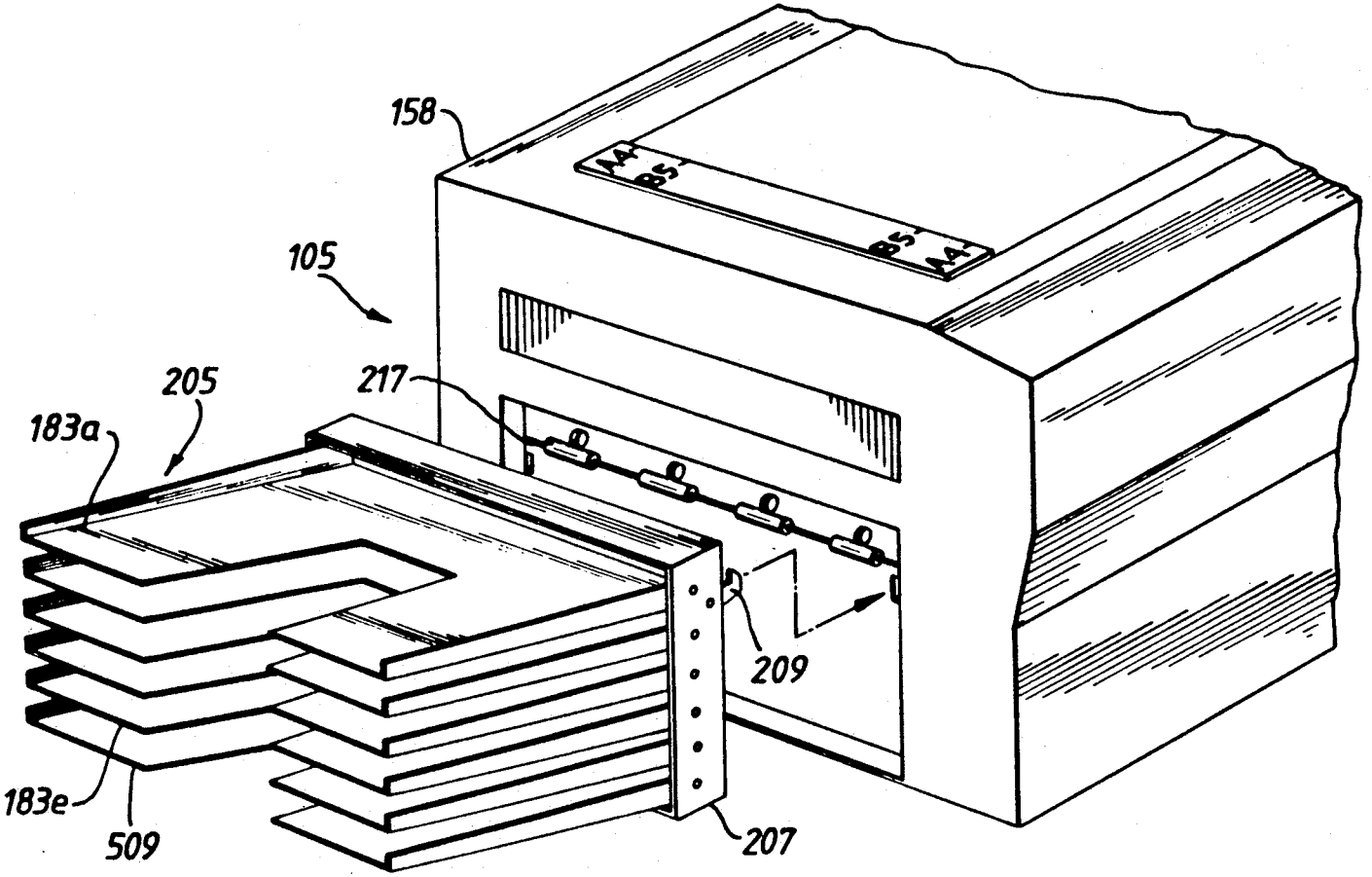
FIG. 2 is a perspective view of the insertion of a tray unit into a main body shown in FIG. 1.

Referring now to FIG. 2, sorting unit 105 includes a tray unit 205 which is detachably connected to main body 158. Tray unit 205 includes a plurality of trays 183 to receive the copied sheets. Trays 183 are supported by a frame 207 in a vertical direction and with inclination. Frame 207 has connecting means, such as a lever 209 to connect tray unit 205 with main body 158 which includes distributing means, such as a sheet sorting device 211 (shown in FIG. 3).

Figure 3:
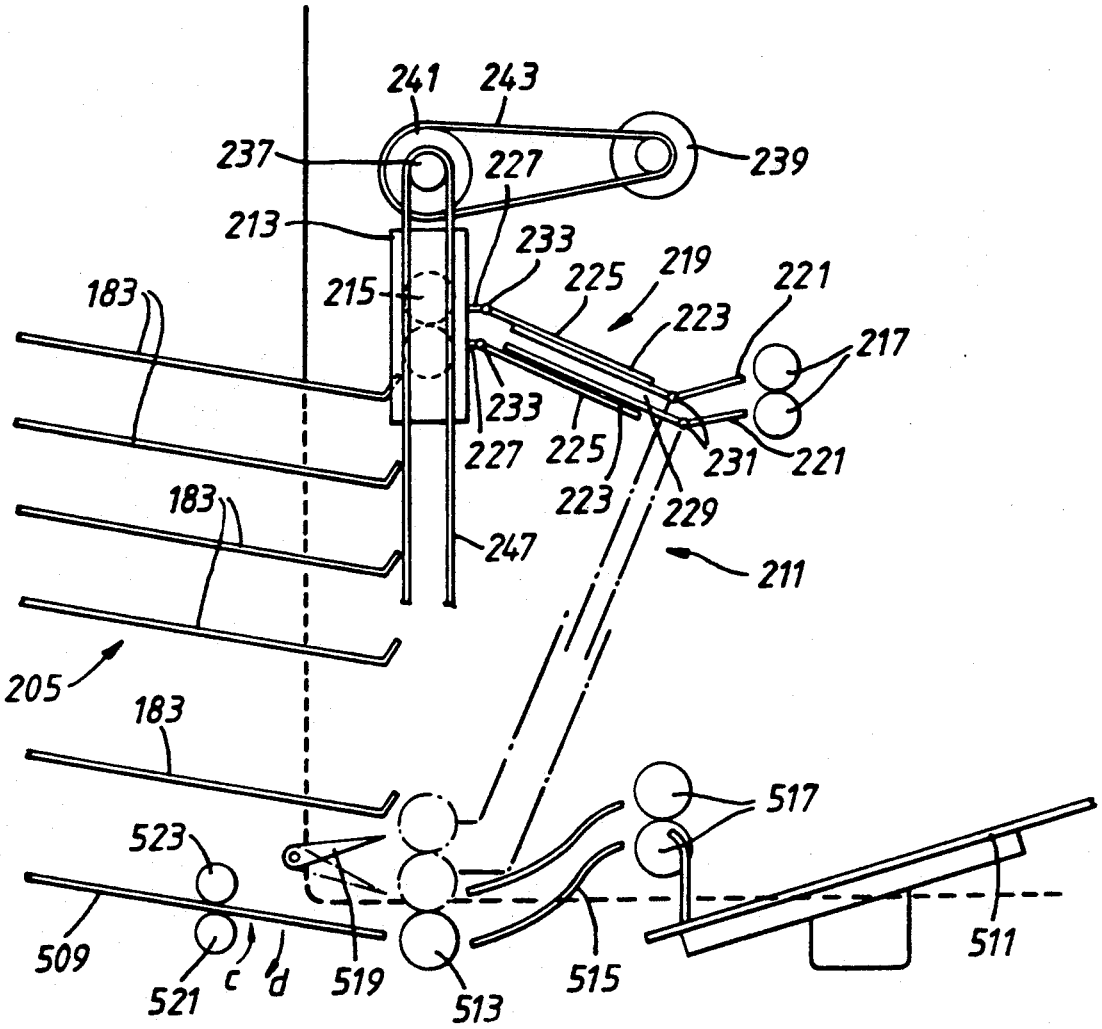
FIG. 3 is a side view of the drive mechanism of a roller unit in the sorting unit shown in FIG. 1.

Referring now to FIG. 3, sheet sorting device 211 includes moving means, such as a roller unit 213 with a pair of discharging rollers 215 to discharge the copied sheet on each tray 183. The copied sheet is fed through a fuser-exit roller 217 and a guide unit 219 from fixing unit 181.

Guide unit 219 is constructed as follows:

Guide unit 219 comprises first to fourth guide plates 221, 223, 225 and 227 which, respectively, form vertical pairs to define a passage 229 for guiding the sheet. One end of first guide plate 221 faces fuser-exit roller 217. Second guide plates 223 are rotatably connected at one end to the other ends of first guide plates 221 via pins 231. Third guide plates 225 slidably receive therebetween the other ends of second guide plates 223. The farther ends of third guide plates 225 are rotatably connected via pins 233 to ends of fourth guide plates 227. The other ends of fourth guide plates 227 are fixed to roller unit 213.

Figure 4:
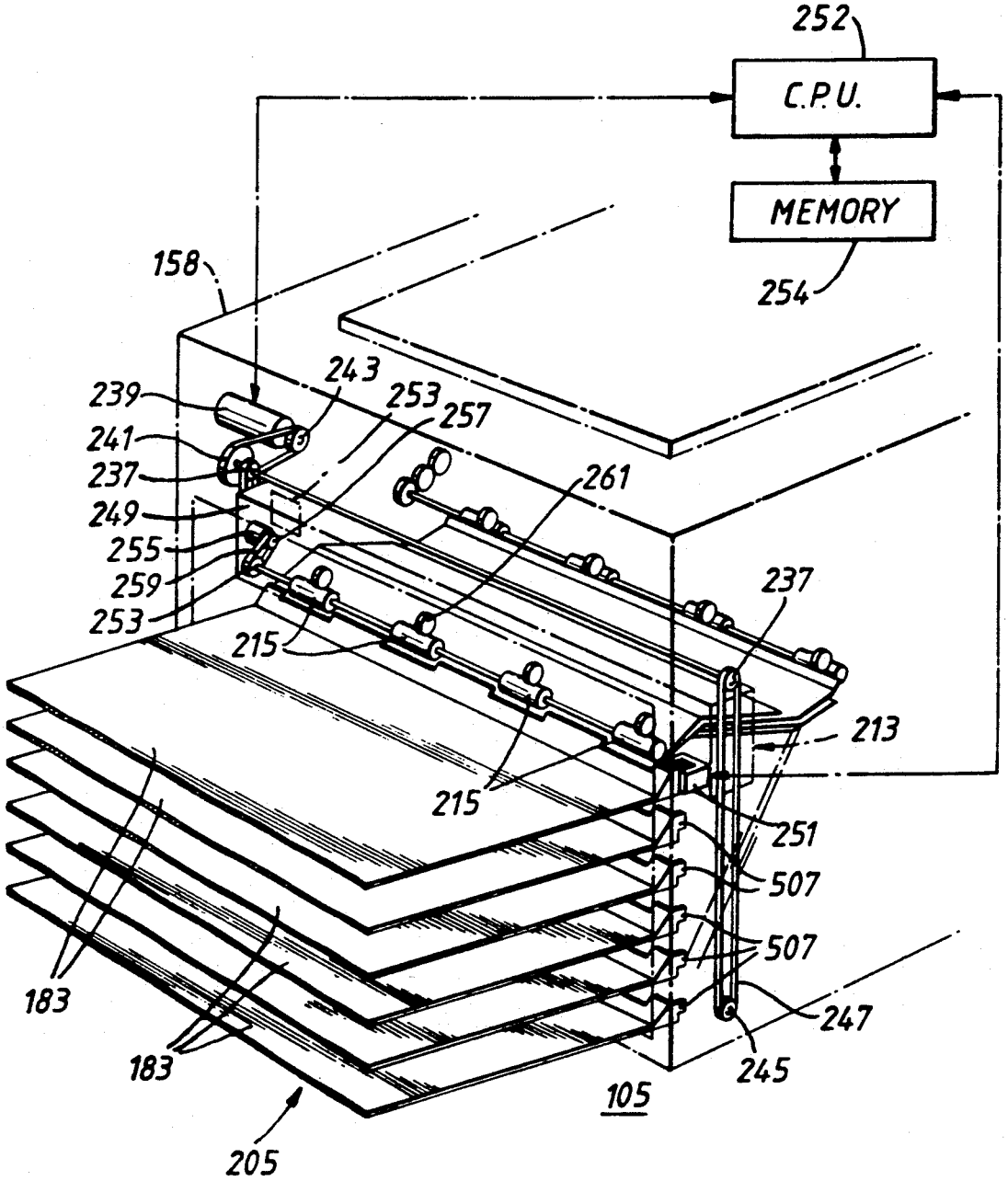
FIG. 4 is a perspective view of the sorting unit used in the copying machine shown in FIG. 1.

Roller unit 213 is movable upward and downward as follows:

Referring now to FIG. 4, over roller unit 213, with a space therebetween, are deposited a pair of upper pulleys 237 which are driven by a pulse motor 239 through a pulley 241 and a belt 243. At the bottom of sorting unit 105 with the same space as that between pulleys 237 are deposited a pair of lower pulleys 245 which are connected to upper pulleys 237 by a toothed timing belt 247.

Toothed timing belt 247 moves roller unit 213 upward and downward. Roller unit 213 includes a unit frame 249. On the both sides of unit frame 249 are secured toothed projections (not shown) which gear into toothed timing belt 247. Toothed timing belt 247 and toothed projection moves at the same time that roller unit 213 is moved.

The front side of unit frame 249 faces trays 183 of tray unit 205. At lower corner of the front side of unit frame 249 is deposited a tray detecting device 251 for detecting a position of one tray 183 while unit frame 249 moves upward and downward. Tray detecting device 251 also detects whether or not tray unit 205 is inserted into main body 158 at the same time as tray detecting device 251 detects the position of tray 183. Tray detecting device 251 may include two elements, e.g., first detecting means for detecting whether tray unit 205 is connected to main body 158 and second detecting means for detecting the position at which tray 183 is connected to tray unit 205. Tray detecting device 251 is also connected to a controlling means, such as a CPU (Central Processing Unit) 252. CPU 252 with memory 254 is connected to the electrical elements, e.g., pulse motor 239. Detail of tray detecting device 251 will be referred hereafter. A microswitch 253 detects whether unit frame 249 is at the uppermost position. A lower microswitch (not shown in FIG. 4) detects whether unit frame 249 is at the lowermost position. Upper microswitch 253 is located at the uppermost position, or as far as unit frame 249 moves. This uppermost position is referred to as home position hereafter. The lower microswitch is deposited at the lowermost position, or as far as unit frame 249 moves.

Referring now to FIG. 3, pulse motor 239 makes roller unit 213 (unit frame 249) to move upward and downward as described herebefore. Fourth guide plates 233, which are fixed to roller unit 213, move upward and downward with roller unit 123. First guide plates 221, which are fixed to to main body (not shown), are fixed in spite of the motion of roller unit 213. Second and third guide plates 225 pivotally connected to pins 231 and 233 are forced to move upward and downward rotationaly. Simultaneously, second guide plates 223 slide on third guide plates 225 so that the length of sheet guiding passage 229 between pins 231 and 233 is increased or decreased. When roller unit 213 is located at the home position, second guide plates 223 are inserted most deeply into third guide plates 225. Sheet guiding passage 229 from fuser-exit roller 217 to discharging roller 215 become the shortest. Whereas, when roller unit 213 is located at the lowermost position, second guide plates 223 are, as shown in imaginary lines in FIG. 3, most shallowly inserted into third guide plates 225. Sheet guiding passage 229 from fuser-exit roller 217 to discharging roller 215 becomes the longest.

Referring now to FIG. 4, in unit frame 249 is secured a pulse motor 255 to drive discharging rollers 215 through a pulley 257 and a belt 259. Discharging rollers 215 face following rollers 261 which are supported by a shaft (not shown) secured in unit frame 249.

Figure 5:
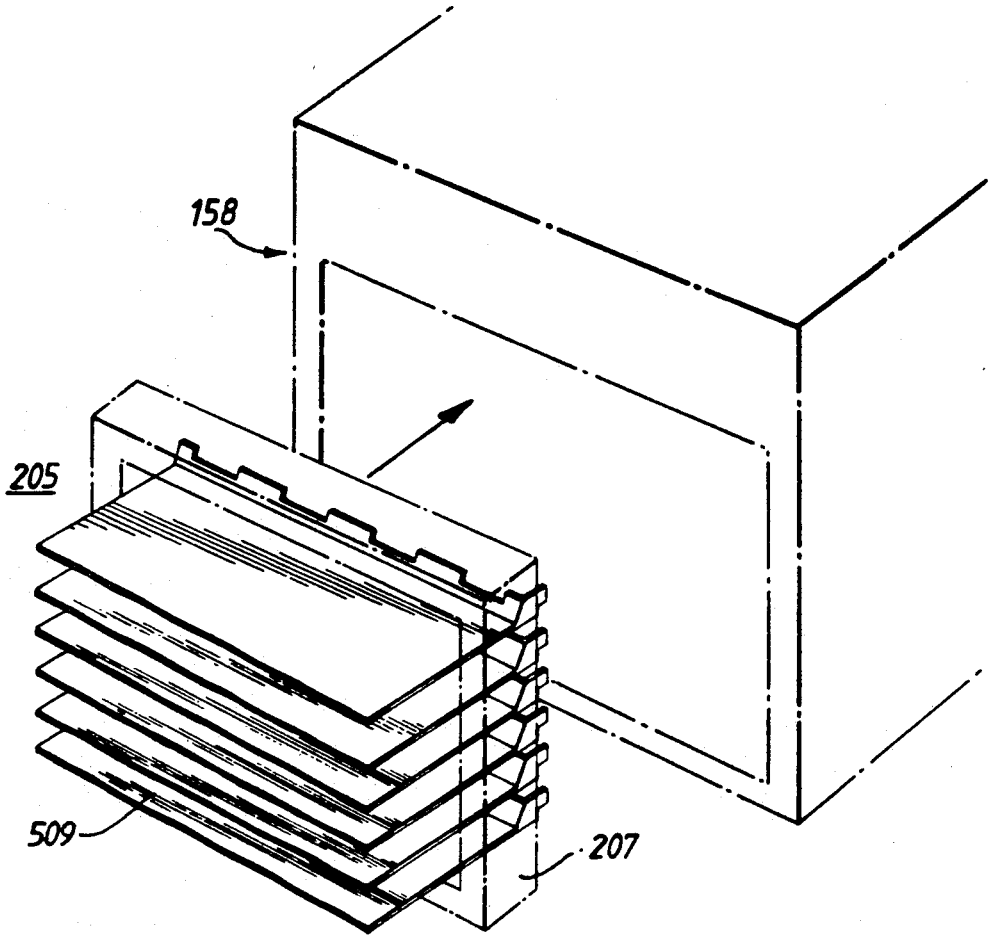
FIG. 5 is an exploded perspective view of the insertion of the tray unit into the main body shown in FIG. 1.

Referring now to FIG. 5, tray unit 205 includes frame 207 which fits into a space in the side of main body 158. Each tray 183 is detachably connected to frame 207.

Figure 6:
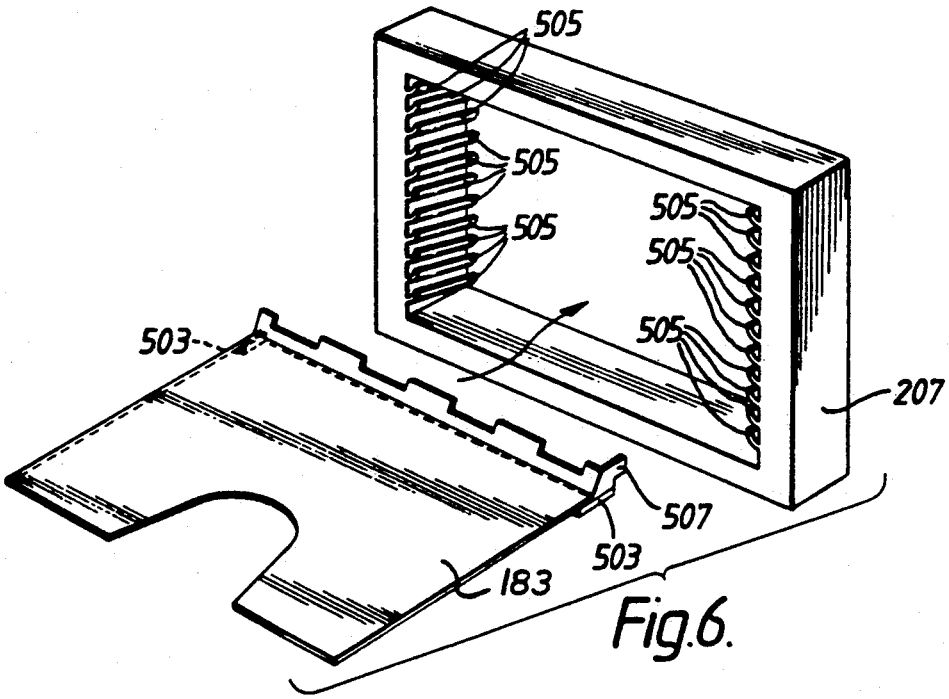
FIG. 6 is an exploded perspective view of the tray unit shown in FIG. 2.

Referring now to FIG. 6, tray unit 205 includes a plurality of trays 183 which are detachably connected to tray frame 207 by connecting means, such as projections 503 and long hooks 505. Each tray 183 has second docking means, such as a pair of projections 503 at both of corners facing frame 207. Frame 207 has first docking means, such as a plurality of long hooks 505, which each projection slides and stickes into. Long hooks 505 are slantingly deposited on the inner sides with a predetermined space. In the other way, each tray 183 may have first docking means and frame 207 may have second docking means. According to the number to be sorted or the number of originals D, the selected trays 183 are inserted into selected hooks 505 of frame 207. If the number of original D is large, each tray 183 must store a plurality of sheets so that fewer trays 183 are inserted into frame 207 through projections 503 and hooks 505. If the number of sorting is large, a plurality of trays 183 are needed so that a plurality of trays 183 are inserted into frame 207 through projection 503 and hooks 505.

Each tray 183 has an indicating means, such as an upper projection 507 to be detected by tray detecting device 251 (shown in FIG. 4). Upper projection 507 is deposited at one corner facing frame 207.

Referring now to FIG. 4, tray detecting device 251 is U-shaped. Tray detecting device 251 moves upward and downward through upper projection 507. Upper projection 507 goes through the gap of tray detecting device 251 so that tray detecting device 251 detects upper projection 507.

Tray detecting device 251 has a light emitting device (not shown) for emitting light mounted on one side of the gap of device 251. The emitted light is received by a light receiving device (not shown), for receiving emitted light, mounted on the other side of the gap of device 251. If tray detecting device 251 is located at tray 183, upper projection 507 intercepts the light between the light emitting device and the light receiving device. The light receiving device fails to receive the emitting light so that tray detecting device 251 detects tray 183.

Referring now to FIG. 1, at the bottom of tray unit 205 is secured a reversing tray 509 for reversing the sheet. The discharged sheet from copying unit 101 to reversing tray 509 is conveyed to a stacking tray 511 through a roller 513, a guide 515 and feeding rollers 517. The sheet on stacking tray 511 is picked up and conveyed to aligning roller 167 again.

Referring now to FIG. 3, over reversing tray 509 is deposited a gate 519 which moves between an upper and a lower positions. Gate 519 in the upper position guides the sheet from roller unit 213 onto reversing tray 509. The guided sheet is fed into between a reversible roller 521 and a following roller 523. Reversible roller 521 rotates to convey the sheet toward outside in cooperation with following roller 521. After the sheet is free from discharging roller 215, reversible roller 521 rotates reversibly. At the same time gate 519 is located in the lower position to prohibit the sheet from going back toward discharging rollers 215. The sheet free from discharging roller 215 is conveyed to feeding roller 513. After the sheet is conveyed to feeding roller 517, feeding roller 517 conveys the sheet onto stacking tray 511 through guide 515. The individual of the sheets on stacking tray 511 is picked up by a pick-up roller 523. The picked-up sheet is conveyed to aliging roller 167 so that the toner image is transferred onto the other side of the sheet.

Referring now to FIG. 5, reversing tray 509 is detachably connected to tray frame 207 at the lowermost position of tray frame 207. Reversing tray 509 has indicating means and connecting means, such as three projections as same as projections 503 and 507. The projection, corresponding to upper projection 507, of reversing tray, may have a different shape or a different transmission factor from upper projection 507 for distinguishing it.

Referring now to FIG. 1, main body 158 contains a fan to cool its inside.

Next, the operation of the copying machine described or above will be explained by a plurality of examples.

Figure 7A:
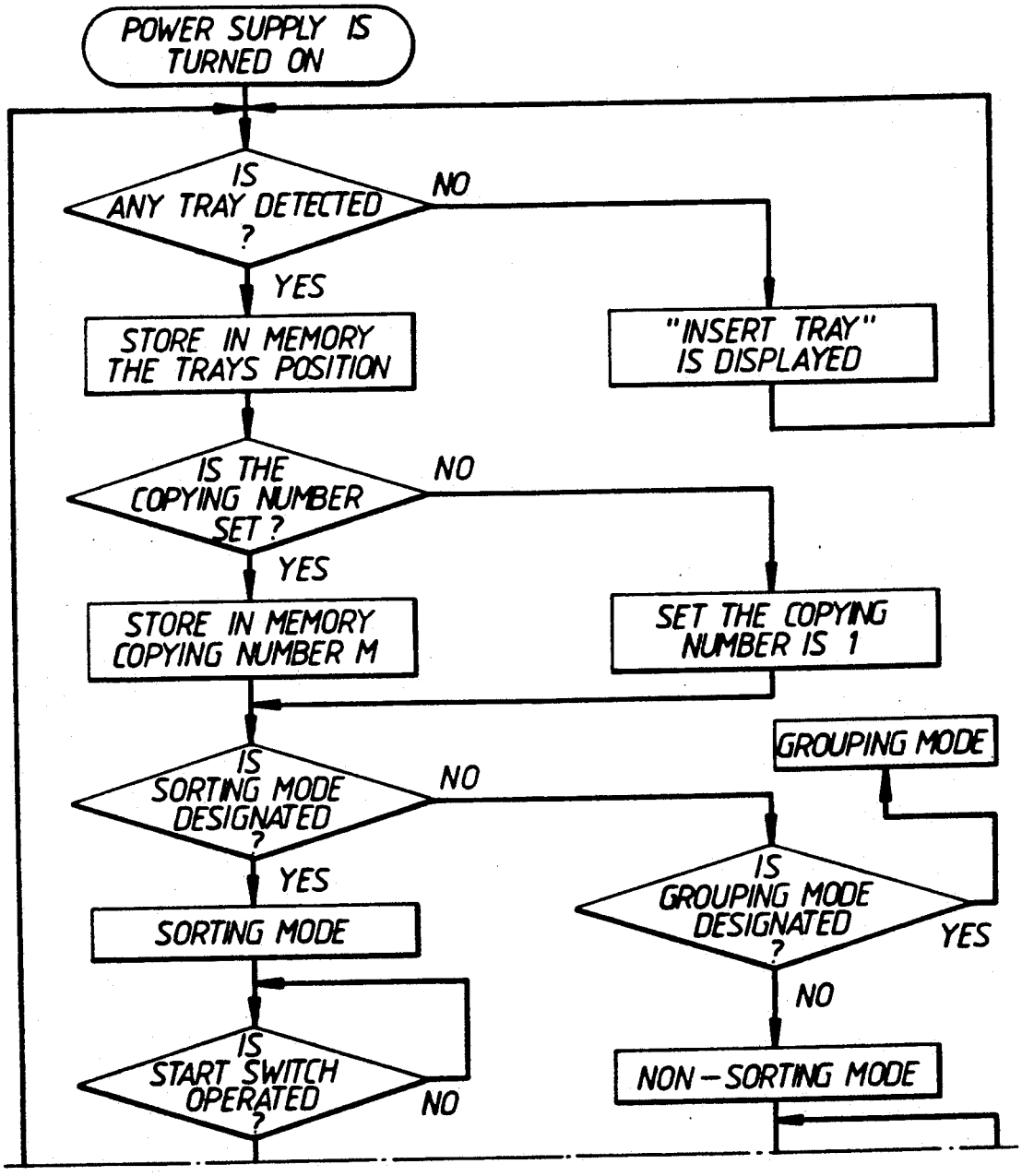
Figure 7B:
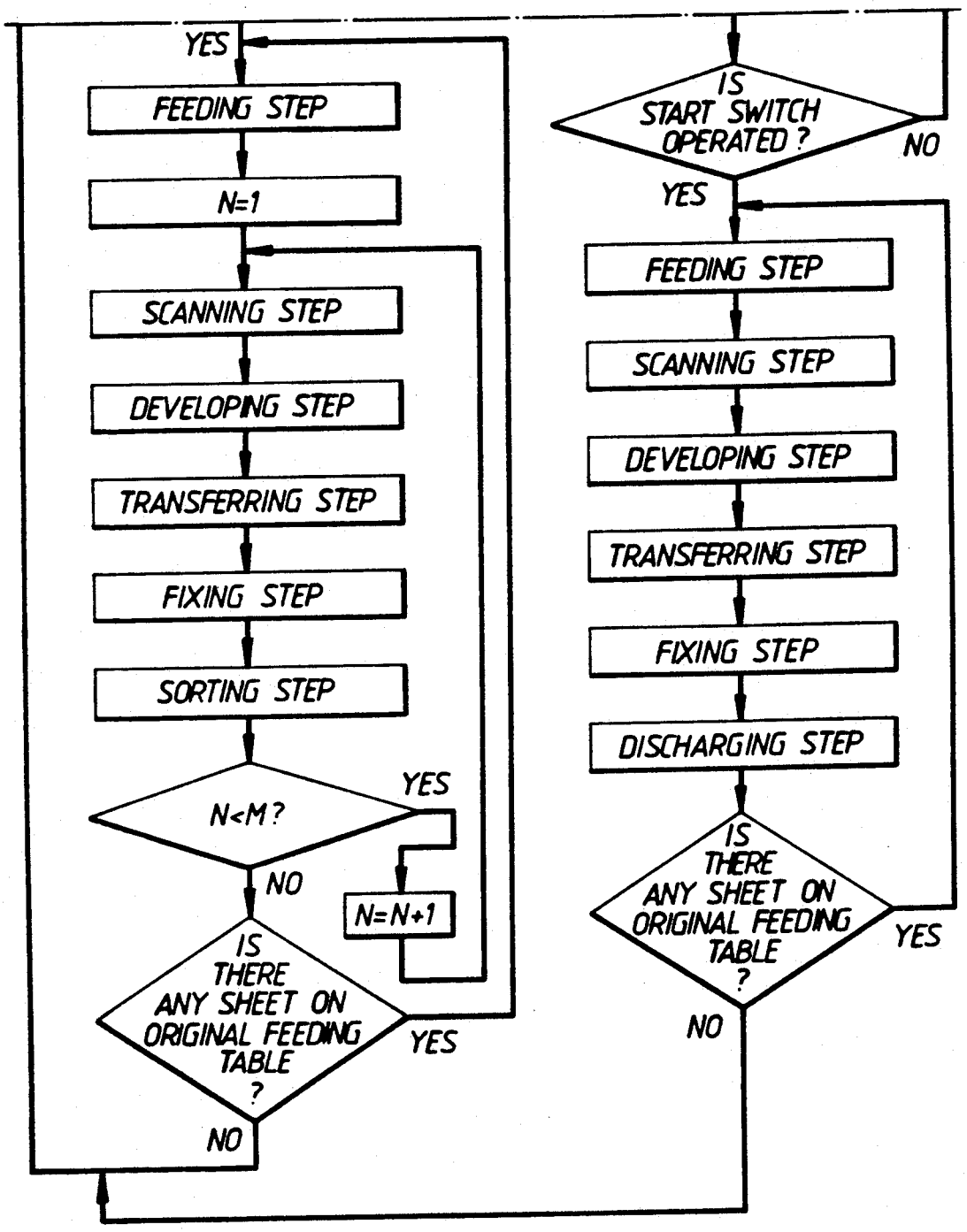

The first example is to make five copies of fifty originals D. Referring now to FIGS. 7*a* and 7*b*, after a power supply (not shown) is turned on, CPU 252 makes pulse motor 239 rotate. The light emitting device and the light receiving device of tray detecting device 251 begin to detect trays 183 during moving downward. Roller unit 213 moves from the home position to the lowermost position of sorting unit 213 and back to the home position. During the movement of roller unit 213, if the light receiving device continues receiving the emitting light, tray detecting device 251 fails to detect any tray 183 in sorting unit 105. To CPU 252 of main body 158 tray detecting device 251 sends the information that tray detecting device 251 fails to detect any tray 183. Based on the information, CPU 252 supposes that there is no tray unit 205 in main body 158. CPU 252 controls a display (not shown) on main body 158 so that the message "INSERT TRAY" is displayed. The message leads an operator to insert tray unit 205 into main body 158.

During the movement of roller unit 213, if the light receiving device fails to receive the emitting light, tray detecting device 251 detects tray 183 in sorting unit 105. At this time tray detecting device 251 sends to CPU 252 the information that device 251 detects tray 183, synchronously with a pulse signal which CPU 252 supplies to pulse motor 239. By using the information, CPU 252 confirms that tray unit 205 is inserted into main body 158 and determines the position of tray 183. CPU 252 stores the information in a memory 254. The information is used in sorting as described hereafter. CPU 252 can also use the position information to determine if reversing tray 509 is present since this type of tray occupies the position at the bottom of tray unit 205. In this manner, CPU 252, by means of the signal from detecting device 251, can determine whether the detected tray is the reversing type of tray. In this case, tray detecting device 251 may perform the function of reading means for reading the indicating means, such as a projection.

The checking process as described above may be performed after a start switch (not shown) is operated. In this case, after checking process, the copying machine begins to duplicate.

The operator sets originals D on original feeding table 187 such that the right side of original D faces original feeding table 187. After setting original D, the operator operates an operating panel (not shown) on main body 158 so that the number of copies is set. If the operator fails to set the number of copies, CPU 252 sets one or the last set number as the number of copies.

If the operator wants to arrange the copying sheet P in the sorting or grouping mode, the operator designates the sorting or grouping mode through the operating panel. In sorting mode, the sheets are arranged in the units of copy so that the operator gets a plurality of copies. In grouping mode, the sheets are arranged in the unit of pages so that the operator gets a plurality of duplication of the same page on the different trays 183. In this case for illustration, the operator sets the sorting mode.

CPU 252 checks whether the number of trays 183 detected by device 251 is less than that designated through the operating panel. If the number of trays 183 detected by device 251 is less than that designated, CPU 252 controls the display so that the message "CHANGE TRAY" is displayed. If the number of trays 183 detected by device 251 is not less than that designated, CPU 252 begins to copy after the start switch is operated.

CPU 252 waits until the start switch is operated. If the start switch is operated, the copying machine begins to do the copying process.

The copying process includes a feeding step, a scanning step, a developing process, a transferring process, a fixing process and a sorting process. All processes except the sorting process are done by a plurality of elements as described before. For a convenience of explaining the control of a plurality of copies in the present embodiment, two variable are introduced. One is the copying number M. Another number is N, indicating the number of duplicating.

In this case, each original is duplicated in five times, e.g., the scanning step, the developing process, the transferring process and the fixing process are performed in five times per one feeding step. After the repetition from the scanning step to the fixing step in the designated times, the duplicated original D is conveyed out of original document table 107. Another original D is fed onto original document table 107. The steps as described above are done over again until there in no original D on original feeding table 187. If all of originals D are duplicated, CPU 252 detectes trays 183 again for preparing to copy next time.

As described above, CPU 252 may get the information about the position of trays 183 from tray detecting device 251 after the start switch is operated and before the feeding step is done.

In the non-sorting mode, after the feeding step and the fixing step are done, the sheet with the image is discharged onto the top tray 183 of tray unit 205.

Referring now to FIG. 8, the first copied sheet P for the first original D is discharged onto the top tray 183*a* of tray unit 205 through fuser-exit roller 217 and discharging roller 215. At this time, discharging roller 215 of roller unit 213 (shown in FIG. 3) is located at the home position, that is, the uppermost position of tray unit 205 so that discharging roller 215 faces top tray 183*a*. After the first copied sheet P is discharged onto top tray 183*a*, roller unit 213 including discharging roller 215 is moved downward toward the position facing a second tray 183*b*.

Referring now the FIG. 4, CPU 252 makes pulse motor 239 rotate so that roller unit 213 is moved upward and downward through belt 243, pulleys 241 and 237 and timing belt 247. Using the information of tray's position stored in memory 254, CPU 252 translates the adjacent tray's position into the distance from the home position to the second tray 183*b*. CPU 252 makes pulse motor 239 rotate for the time corresponding to the distance. Move roller unit 213 toward the following tray 183 must be finished before another sheet is discharged. In the present embodiment, it is a much shorter time for roller unit 213 to move from tray 183 toward the following tray 183, because pulse motor 239 moves roller unit 213.

In duplicating the original D, roller unit 213 moves from the upper tray 183 to the lower tray 183. After roller unit 213 is moved to the fifth tray 183*e*, CPU 252 supposes that fifth tray 183*e* is the lowermost tray of tray unit 205 because tray 509 is used in reversing. CPU 252 fails to moves roller unit 213 downward to reversing tray 509 and moves roller unit 213 upward to the home position. The time for moving back to the home position is much shorter because pulse motor 239 is used.

The first copying sheet of second original D is discharged onto the top tray 183*a*. The sorting operation lasts until the entire of fifty originals D are duplicated fifth times.

As described above, trays 183 are used for a single-sided copy and usually sorting. Reversing tray 509 is used for a double-sided copy.

Referring now to FIG. 3, the operator operates a switch indicating a double-sided copying mode. CPU 252 moves roller unit 213 to the lowermost position, that is, the position facing reversing tray 509. CPU 252 makes gate 519 being in the upper position and reversing roller 521 rotate counterclockwise indicated by an arrow c. The sheet from fuser-exit roller 217 is discharged onto reversing tray 509 guided by upper position gate 519. The discharged sheet is conveyed between reversing and following rollers 521 and 523, so that reversing and following rollers 521 and 523 convey the sheet.

When CPU 252 finds the rear end of the sheet at the position between roller unit 213 and reversing roller 521 by using a microswitch (not shown), CPU 252 makes reversing roller 521 rotate clockwise, indicated by an arrow d and gate 519 being in the lower position shown as an imaginary line. Roller 521 conveys the sheet toward between roller 513 and the lower of roller unit 213. The sheet is conveyed onto stacking tray 511 through tray guide 515 and feeding rollers 517. The surface with no toner image faces stacking tray 511. The sheet on stacking tray 511 has the toner image on the right side of the sheet.

Referring now to FIG. 1, the individual sheets on stacking tray 511 are picked up by pick-up roller 525. The picked up sheet is conveyed to transfer device 133 and separation device 135 through aligning roller 167. The side with no toner image faces the surface of photosensitive drum 109. New toner image is transferred onto the side which has no toner image. The toner image is made on the both sides of the sheet. The sheet is discharged onto the top tray 183 after discharging roller 215 of roller unit 213 moves to home position. The double-sided copy sheet may be discharged onto any tray 183 or tray 509, which may be designated through the operating panel.

The second case is that one hundred of original D is duplicated three times. Referring now to FIGS. 9 and 10, tray unit 205 with three trays 183*a*, 183*b* and 183*c* and one reversing tray 509 is inserted into main body 158. The sheets from copying unit 101 (shown in FIG. 1) are distributed onto tray 183*a*, 183*b* and 183*c* as in the same way as the first case.

Referring now to FIG. 11, in non-sorting mode, tray unit 205 may include one tray 183*a*. In non-sorting mode, tray unit 205 may include a plurality of trays 183 as shown in FIG. 2 or 4. In non-sorting mode, roller unit 213 stays on the same position of tray unit 205 irrespective of the number of trays 183 during discharging the sheets.

What is claimed is:

1. A sorting apparatus for an image forming apparatus, comprising:

discharging means at a fixed position for discharging sheet materials from said image forming apparatus;

a tray unit including a plurality of trays defining respective openings arrayed to receive the sheet materials through the openings;

distributing means, movable along the arrayed openings of said tray unit and spaced from said discharging means by a distance that varies as said distributing means moves, for distributing the sheet materials discharged from said discharging means to each of the trays;

guide means for guiding the conveyance of the sheet materials discharged from said discharging means to said distributing means, said guide means including a first pair of plates of which one set of ends are pivotably mounted at the vicinity of said discharging means to define a first conveyance path therebetween, and a second pair of plates of which one set of ends are pivotably mounted to said distributing means and the other set of ends of said second pair of plates are slidably connected to the other set of ends of said first pair of plates to define a second conveyance path therebetween operatively connecting to the first conveyance path constituting a guide path, the length of the guide path being varied according to said distance.

2. The apparatus of claim 1, wherein said first pair of plates is slidably contained within said second pair of plates.

* * * * *